United States Patent [19]

O'Brien

[11] 4,389,200

[45] Jun. 21, 1983

[54] WATER SKI BINDING

[76] Inventor: Herbert J. O'Brien, 2832 West Lake Sammamish Northeast, Redmond, Wash. 98052

[21] Appl. No.: 250,602

[22] Filed: Apr. 3, 1981

[51] Int. Cl.[3] ..... A63C 5/00

[52] U.S. Cl. ..... 441/70; 280/618

[58] Field of Search ..... 280/11.3, 618; 36/11.5; 9/310 R, 310 A, 310 AA, 304; 441/70

[56] References Cited

U.S. PATENT DOCUMENTS

| | | | |
|---|---|---|---|
| 2,190,982 | 2/1940 | Gilbert | 36/11.5 |
| 2,221,132 | 12/1940 | Girardi | 36/11.5 |
| 2,939,159 | 6/1960 | Cravotta | 9/310 AA |
| 3,118,157 | 1/1964 | Houser | 9/310 AA |
| 3,396,479 | 8/1968 | Primak | 280/618 |
| 3,801,119 | 4/1974 | Andre | 280/618 |
| 3,925,913 | 12/1975 | DelVecchio | 36/11.5 |
| 4,131,963 | 1/1979 | Johnson | 9/310 AA |
| 4,162,089 | 7/1979 | Alber | 280/618 |

*Primary Examiner*—Trygve M. Blix
*Assistant Examiner*—D. W. Keen
*Attorney, Agent, or Firm*—Seed, Berry, Vernon & Baynham

[57] ABSTRACT

A novel water ski binding clamps tongue, heel, and reinforcing strips to a sole plate with screws normal to the edges of the plate. Thus the strips initially extend substantially vertically from the edges rather than substantially horizontal (parallel to the mounting plate) as in the prior art.

16 Claims, 4 Drawing Figures

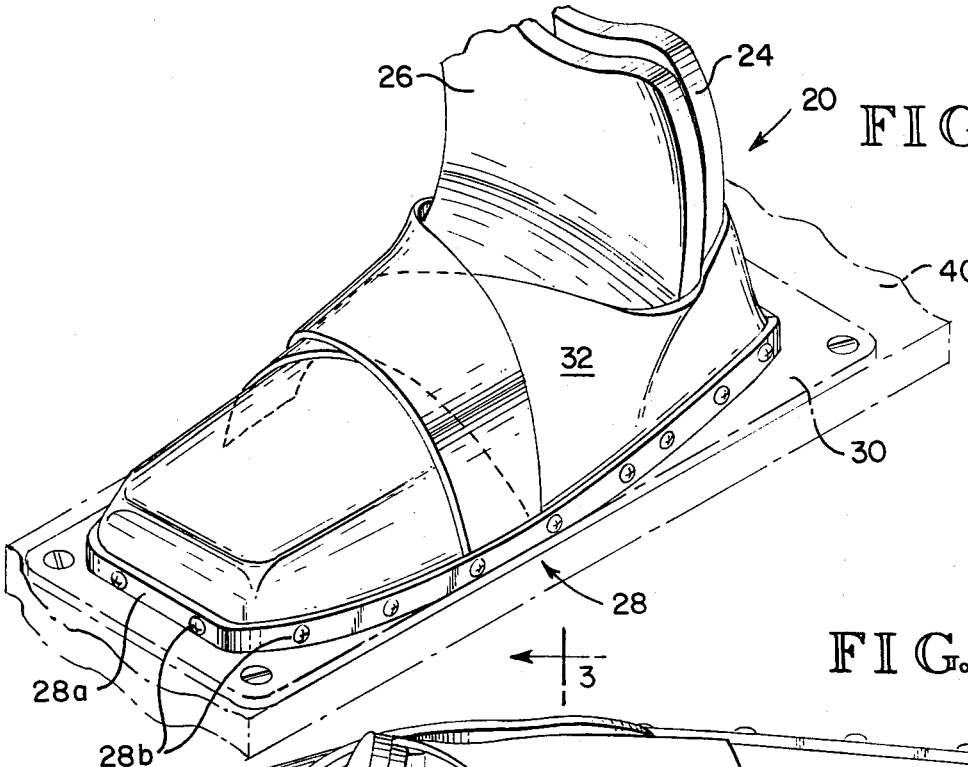
FIG. 1
FIG. 2
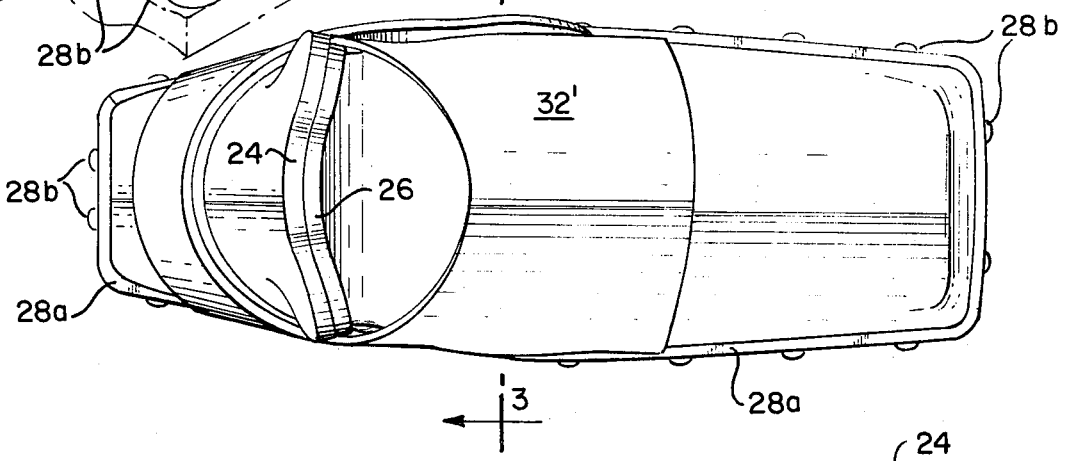
FIG. 3
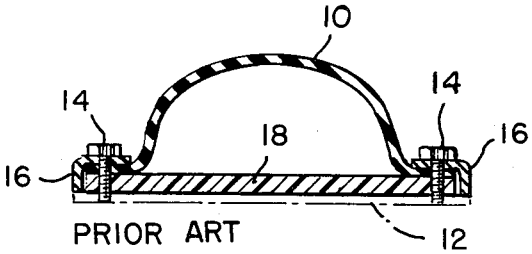
FIG. 4
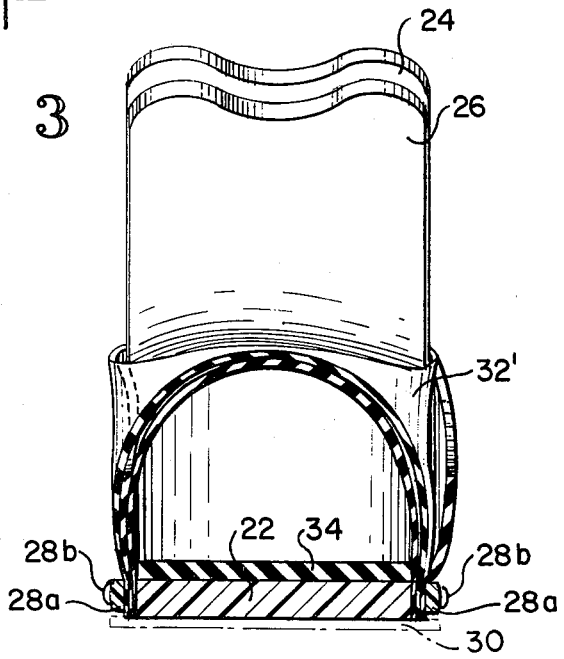

WATER SKI BINDING

DESCRIPTION

1. Technical Field

This invention relates to a novel water ski binding which has an elastomeric tongue and heel portion in the form of an upper boot.

2. Background Art

As shown in FIG. 4, in a common water ski binding, elastomeric strips 10 form a boot by attaching to a mounting plate 12 with L-shaped side clamps 16 and screws 14. Ordinarily, a pad 18 cushions the sole of the foot when the binding is worn.

At least three problems are present with this binding. One, it requires a greater width because the strips 10 initially run parallel to the mounting plate 12. Thus space is wasted in turning the strips from parallel to the plate to perpendicular to the plate. Two, the clamps 16 restrict lateral expansion of the strips by forming a boundary around the boot. Three, the clamps confine the movement of the foot, making it difficult to insert the foot into the binding. The improved water ski binding of this invention solves many of these problems with a simple, efficient, and inexpensive means.

DISCLOSURE OF INVENTION

The water ski binding of this invention has five major parts: a sole plate, a heel, a tongue, means for fastening the tongue and heel to the sole plate, and a mounting plate. The tongue and heel project substantially vertically from edges of the sole plate, thereby providing the least stress on the strips and allowing the greatest flexibility for the boot. The tongue and heel are fastened to the plate by means of screws inserted inward normal to the edge of the mounting plate.

The boot may be reinforced with an additional elastomeric strip which crosses over the instep of the tongue and wraps around the heel, attaching to the sole plate around the back and two side edges with screws in the same manner as the heel and tongue. This reinforcing strip provides added strength for the boot portion of the binding. A pad for the sole may also be used.

BRIEF DESCRIPTION OF THE DRAWINGS

FIG. 1 is a perspective view of the water ski binding of this invention.

FIG. 2 is a top view of an alternate water ski binding of this invention.

FIG. 3 is a section taken along line 2—2 of FIG. 2.

FIG. 4 is a section through a typical prior art water ski binding.

BEST MODE FOR CARRYING OUT THE INVENTION

A water ski binding of this invention has five major parts: a sole plate 22, an elastomeric heel 24, an elastomeric tongue 26, means 28 for fastening the tongue and heel to the sole plate, and a mounting plate 30.

The sole plate 22 is generally in the shape of a foot, having a toe, a back, and two sides. The plate 22 is made of a rigid material, such as a hard plastic or metal. It is thick enough so that means 28 for fastening a heel 24 and tongue 26 may be screwed into the edges of the plate 22 (as best shown in FIG. 3). Rivets, bolts, or other suitable means may be used without departing from the scope of this invention.

The heel 24 and tongue 26 are preferably made from elastomeric material, such as rubberized cloth, natural or synthetic rubber, or the like. Together, the heel 24 and tongue 26 form the boot for the water ski binding and have an entry for the foot between the two portions. Each portion extends substantially vertically upward from the sole plate 22, attaching around the edge with suitable means 28. Both the heel and tongue provide the greatest volume under their surfaces. Entry of a foot into the binding is eased because both the tongue 26 and heel 24 are unconfined by the side clamps prevalent in the prior art.

Additional strength for the boot may be obtained by attaching suitable means 32 or 32' to reinforce the tongue and heel. These reinforcement means may be an additional elastomeric strip of rubberized cloth, natural or synthetic rubber, or the like. As shown in FIG. 1, the means 32 for reinforcing is an elastomeric strip which crosses over the instep of the tongue 26, wraps around the heel 24, and attaches to the sole plate 22 along the back and two sides. FIG. 2 shows an alternate means 32' for reinforcing which has an elastomeric strip which forms an inverted U over the instep of the tongue 26, has a loop which passes around the heel 24, and attaches to the sole plate 22 along the two sides. The reinforcement of FIG. 2 is preferred. The means 28 for fastening the tongue 26, heel 24, and reinforcing strip 32 or 32' generally comprises a plurality of screw plates **28*a* which fit around the edge of the sole plate 22, substantially matching its outside perimeter. Each screw plate 28*a* has a plurality of holes through which screws 28*b* may be inserted and may be screwed into the edges of sole plate 22. As the screws 28*b* are inserted through the heel 24, tongue 26, and reinforcing strip 32 or 32'**, they compress these elastomeric materials taut against the edge of the sole plate and hold them firmly in place.

A preferred water ski binding includes a foam pad 34 which is glued to the upper surface of the sole plate 22 for additional padding and cushioning for the sole of the foot when the foot is inserted in the binding.

The sole plate 22 is attached to a mounting plate 30, which is generally a rectangular, thin metal plate that is screwed to the water ski 40. Any suitable means may be used to attach the sole plate 22 to the mounting plate 30, such as adhesives or screws. The mounting plate 30 functions as an easy means for attaching the water ski binding to the water ski 40. It allows manufacture of the boot portions of the binding independently of the water ski and readily allows adapting the water ski binding of this invention to almost any type of water ski.

While preferred embodiments of this invention have been shown and described, those skilled in the art will understand that numerous modifications may be made without departing from the scope of this invention. Therefore, this invention should not be limited to the preferred embodiments unless limitation is necessary in light of either the prior art or the scope and nature of the appended claims.

I claim:

1. A water ski binding comprising:

(a) a substantially rigid, unhinged sole plate having top and bottom generally planar surfaces and an edge comprising a surface generally perpendicular to said top and bottom surfaces around a toe, a back, and two sides;

(b) an initially flat elastomeric tongue bent about and attached to the edge of the plate on the toe and two sides;

(c) an initially flat elastomeric heel bent about and attached to the edge of the plate on the back and two sides; and (d) means for fastening the tongue and heel to the plate so that each projects substantially vertically at the point of contact with the plate, the means for fastening being adapted to retain the greatest flexibility for the elastomeric material of the tongue and heel and being adapted to allow substantially unrestricted lateral expansion of the elastomeric tongue and heel around the edges of the plate.

2. The binding of claim 1 wherein the means for fastening includes a plurality of screws and screw plates, the screws being placed through the tongue and heel normal to the edge of the plate.

3. The binding of claim 1, further comprising means for reinforcing the heel and tongue.

4. The binding of claim 3 wherein the means for reinforcing is an elastomeric strip which crosses over the instep of the tongue, wraps around the heel, and attaches to the plate along the edge on the back and two sides.

5. The binding of claim 3 wherein the means for reinforcing is an elastomeric strip which forms an inverted U over the instep of the tongue, has a loop which passes around the heel, and attaches to the plate along the edge on two sides.

6. The binding of claim 1, further comprising a pad attached to the top surface of the plate.

7. The binding of claim 1, further comprising a mounting plate attached to the bottom surface of the plate.

8. A water ski binding comprising:

(a) a substantially rigid, unhinged sole plate having top and bottom generally planar surfaces and a toe, a back and two side edges comprising surfaces generally perpendicular to said top and bottom surfaces (b) an initially flat elastomeric tongue bent about and attached to the edge of the plate around its toe and two sides with fastening means placed through the tongue into the plate normal to the toe and two side edges;

(c) an initially flat elastomeric heel bent about and attached to the edge of the plate around its toe and two sides with fastening means placed through the heel into the plate normal to the back and two side edges; and (d) an elastomeric strip to reinforce the tongue and heel which crosses over the instep of the tongue, wraps around the heel, and attaches to the edge of the plate along the back and two side edges with fastening means placed through the strip into the plate normal to the back and two side edges, wherein the fastening means for both the tongue and heel are adapted to retain the greatest flexibility for the elastomeric material of the tongue and heel and are adapted to allow substantially unrestricted lateral expansion of the elastomeric tongue and heel around the edges of the plate.

9. The binding of claim 8, further comprising a pad attached to the top surface of the plate.

10. The binding of claim 8, further comprising a mounting plate attached to the bottom surface of the plate.

11. A water ski binding comprising:

(a) a substantially rigid, unhinged sole plate having top and bottom planar surfaces and a toe, a back and two side edges comprising surfaces generally perpendicular to said top and bottom surfaces;

(b) an initially flat elastomeric tongue bent about and attached to the edge of the plate around its toe and two sides with means placed through the tongue into the plate normal to the toe and two side edges;

(c) an initially flat elastomeric heel bent about and attached to the edge of the plate around its heel and two sides with fastening means placed through the heel into the plate normal to the back and two side edges;

(d) an elastomeric strip to reinforce the tongue and heel which crosses over the instep of the tongue, wraps around the heel, and attaches to the edge of the plate along the back and two side edges with fastening means placed through the strip into the plate normal to the back and two side edges;

(e) a pad attached to the top surface of the plate; and (f) a substantially rigid mounting plate attached to the bottom surface of the plate, wherein the fastening means for both the tongue and heel are adapted to retain the greatest flexibility for the elastomeric material of the tongue and heel and are adapted to allow substantially unrestricted lateral expansion of the elastomeric tongue and heel around the edges of the plate.

12. A water ski binding comprising:

(a) a substantially rigid, unhinged sole plate having top and bottom planar surfaces and a toe, a back and two side edges comprising surfaces generally perpendicular to said top and bottom surfaces;

(b) an initially flat elastomeric tongue bent about and attached to the edge of the plate around its toe and two sides with fastening means placed through the tongue into the plate normal to the toe and two side edges;

(c) an initially flat elastomeric heel bent about and attached to the edge of the plate around its heel and two sides wih fastening means placed through the heel into the plate normal to the back and two side edges; and (d) an elastomeric strip to reinforce the tongue and heel which forms an inverted U over the instep of the tongue, has a loop which passes around the heel, and attaches to the edge of the plate along the two sides with fastening means placed through the strip into the plate normal to the side edges;

(e) a pad attached to the top surface of the plate; and (f) a substantially rigid mounting plate attached to the bottom surface of the plate, wherein the fastening means for both the tongue and heel are adapted to retain the greatest flexibility for the elastomeric material of the tongue and heel and being adapted to allow substantially unrestricted lateral expansion of the elastomeric tongue and heel around the edges of the plate.

13. A water ski binding comprising:

(a) a sole plate having top and bottom generally planar surfaces and an edge, comprising a surface generally perpendicular to said top and bottom surfaces, around a toe, a back, and two sides;

(b) an elastomeric tongue attached to the plate on the toe and two sides;

(c) an elastomeric heel attached to the plate on the back and two sides;

(d) means for fastening the tongue and heel to the plate so that each projects substantially vertically at the point of contact with the plate, the means for fastening including a plurality of screws and screw plates, the screws being placed through the tongue and heel normal to the edge of the plate; and (e) means for reinforcing the heel and tongue, including an elastomeric strip which crosses over the instep of the tongue, wraps around the heel, and attaches to the plate along the edge on the back and two sides.

14. The water ski binding of claim 13 wherein the means for reinforcing includes an elastomeric strip which forms an inverted U over the instep of the tongue, has a loop which passes around the heel, and attaches to the plate along the edge on two sides.

15. The water ski binding of claim 13 further comprising a mounting plate attached to the bottom surface of the plate.

16. The water ski binding of claim 14 further comprising a mounting plate attached to the bottom surface of the plate.

* * * * *